United States Patent [19]

Wright

[11] Patent Number: 4,582,204

[45] Date of Patent: Apr. 15, 1986

[54] COLUMN SYSTEMS FOR CHROMATOGRAPHY AND THE LIKE

[75] Inventor: Alfred G. Wright, Gloucestershire, United Kingdom

[73] Assignee: Amicon Wright Limited, Gloucestershire, England

[21] Appl. No.: 510,113

[22] Filed: Jul. 1, 1983

[30] Foreign Application Priority Data

Jul. 2, 1982 [GB] United Kingdom ..... 8219140

[51] Int. Cl.[4] ..... A47F 7/00

[52] U.S. Cl. ..... 211/133; 211/126; 280/79.3

[58] Field of Search ..... 211/151, 126, 133, 134, 211/192, 162, 13; 280/79.3

[56] References Cited

U.S. PATENT DOCUMENTS

| | | | |
|---|---|---|---|
| 968,201 | 8/1910 | Shannon . | |
| 1,367,672 | 2/1921 | Smith . | |
| 1,473,817 | 11/1923 | Gorsline . | |
| 1,708,588 | 4/1929 | Proctor . | |
| 2,982,422 | 5/1961 | Asproyerakas | 211/134 |
| 3,420,379 | 1/1969 | Berryman | 211/1 |
| 3,527,359 | 9/1970 | Lambertson . | |
| 4,462,500 | 7/1984 | Konstant et al. | 211/162 X |
| 4,482,066 | 11/1984 | Dykstra | 211/151 |

FOREIGN PATENT DOCUMENTS

| | | |
|---|---|---|
| 661792 | 11/1951 | United Kingdom . |
| 678763 | 9/1952 | United Kingdom . |
| 686473 | 1/1953 | United Kingdom . |
| 690613 | 4/1953 | United Kingdom . |
| 998434 | 7/1965 | United Kingdom . |
| 1289101 | 9/1972 | United Kingdom . |

*Primary Examiner*—Robert W. Gibson, Jr.

*Attorney, Agent, or Firm*—Stacey L. Channing; William L. Baker

[57] ABSTRACT

A column system for chromatography is provided which comprises (1) a supporting structure for column units having a pair of upright end frames interconnected by pairs of horizontal slide rails at different levels, each pair of slide rails at an individual level being adapted slidably to carry a platform movable along said slide rails, said slide rails being disposed inboard of the uprights of the end frames so that a platform may be slid into and out of engagement with the slide rails by passing through at least one of the end frames, and stop means for preventing unintentional movement of a platform off its associated slide rails; and (2) a plurality of platforms each carrying an individual column unit, each platform including clamping means for securing the platform in a desired position along the slide rail pair on which it rests, said clamping means being integrated with said stop means.

7 Claims, 5 Drawing Figures

COLUMN SYSTEMS FOR CHROMATOGRAPHY AND THE LIKE

DESCRIPTION OF INVENTION

This invention concerns column systems for chromatograpy and like separation procedures, e.g. involving gel filtration, ion exchange and affinity techniques, in which a fluid is caused to flow through a columnar bed of a particulate or divided solid. These separation procedures are used, for instance, in the production and purification of biochemicals such as proteins and hormones. Especially for large scale production processes involving such separation procedures, columns having diameters of the order of one meter may be used.

In carrying out many of these separation procedures an extended bed length is required to achieve the desired degree of separation and/or purification of a material. The containment of a bed of the required length involves a correspondingly extended column: however in addition to the problems of obtaining and maintaining a bed of uniform packing density throughout the length of an extended column, and in maintaining uniform flow throughout the length of such an extended bed, the sheer physical size and weight of a long, large diameter column imposes constraints upon the choice of materials of construction and leads to handling and other operational difficulties. It is therefore the practice to obtain the effect of an extended bed length in a large diameter column by connecting a number of column units, individually of the required diameter but of relatively short bed length, in series by appropriate conduit connections of end cells of the individual column units, so that fluid flows in sequence through the beds in the respective column units.

For a number of reasons it is desirable to arrange the series-connected column units in a vertically superposed array and various supporting structures are being evolved for supporting an array of column units in such superposed relationship. For example, it has been proposed to support each column unit in an individual tubular metal space frame having vertical members the ends of which are designed to mate with the juxtaposed ends of the corresponding members of like frames so that an array of column units may be erected by simple stacking of the supporting frames of the individual units.

The supporting structures so far proposed for superposed series of column units all involve the disadvantage that to obtain access to any column unit other than the topmost unit, all the units above the one to which access is required must be raised clear of that unit to allow it in its turn to be removed if need be, e.g. for repacking of its bed or for rectification of an operational fault therein. Apart from the problem of lifting one or more of the individual column units with its respective supporting structure, the requirement for effective dismantling of the array of units to obtain access to a particular unit in the array necessarily involves an interruption in the separation procedure being carried out, while the physical movement of the unit or units above the one to which access is required can disturb the packing of the beds therein and affect their subsequent performance.

An object of the present invention is therefore to provide a supporting structure for a plurality of individual column units that enables these to be disposed in superposed array while providing unrestricted access to any unit of the array without disturbance of the other unit or units thereof.

In accordance with the invention a supporting structure for column units comprises a pair of upright end frames interconnected by pairs of horizontal slide rails at different levels, each pair of slide rails at an individual level being adapted slidably to carry a platform movable along such slide rails and itself adapted to carry a column unit.

Preferably the slide rails are disposed inboard of the uprights of the end frames and any other structural members so that a platform may be slidden into and out of engagement with the slide rails by passing through at least one of the end frames.

Preferably the platform includes clamping means for securing a platform in a desired position along the slide rail pair on which it rests. Stop means may be provided for preventing unintentional movement of a platform off its associated slide rails and in preferred embodiments such stop means are integrated with the clamping means that thereby provide the dual function of securing a platform to its associated slide rails and preventing inadvertent detachment of such platform from those slide rails when free to move therealong.

Conveniently such integrated clamping and stop means comprise a clamp jaw movable relatively to the platform so as to grip an associated slide rail, the jaw being pivoted to the platform so as to be capable of being swung from a position in which it engages a slide rail and also projects into the path of an end frame member so as to obstruct movement of the platform out through such end frame, to another position in which the jaw clears the path of the end frame member in question to permit removal of the platform through the end frame. The clamp jaw is preferably grooved to engage the slide rail when the clamp jaw is in the position in which it projects into the path of the end frame member, so as to be prevented from being swung out of that position inadvertently and when not deliberately released from engagement with the slide rail.

The pivot for the clamp jaw may be constituted by a bolt or the like by means of which the jaw is moved towards the platform to accomplish clamping of the platform to the slide rail. The arrangement is conveniently such that the swinging of the clamp jaw between its said positions is effected by rotation of the said pivot bolt under the torque resulting from tightening and loosening of a nut or toggle to accomplish clamping and releasing motion of the clamp jaw.

Each platform may provide a simple free support for a column unit. However in preferred embodiments of the invention, each platform is constituted by a suitably configured bottom end plate for an associated column unit that is thereby fixed in position relative to the platform to prevent unwanted relative displacement of the column unit thereon.

Preferably each platform is of nominally rectangular configuration in plan and the supporting structure has its end frames spaced apart by at least twice the length of the platform whereby, from an operating configuration in which all the platforms and their associated column units are disposed adjacent to one end frame of the supporting structure, any selected platform and associated column unit may be slid to a position adjacent to the other end frame and in which it is wholly clear of the column units above and/or below it and thus freely accessible without disturbing any of the other platforms and their associated column units.

The supporting structure may be arranged for permanent, fixed-position, installation and in such case may as required include suitable ground engaging members with, if appropriate, levelling means for achieving verticality of the end frames and horizontal disposition of the platforms supported by the slide rails therebetween. Alternatively and as is preferred, the supporting structure is provided with wheels, preferably including castors, to provide for movement of the structure and an array of column units carried thereby, as may be required for instance in connection with certain separative procedures that have to be carried out in an environment or location, such as a cold room, different from that used in packing the column units and/or setting up the column system, and/or from that to be used in taking down the column system after a separation run.

When the supporting structure includes wheels it preferably also includes levelling arrangements for achieving verticality of the end frames when the structure has been moved to a position of use.

The structure is preferably constructed of stainless steel to withstand exposure to corrosive materials such as it may encounter in a laboratory or biochemical production plant. The platforms may similarly be constructed of stainless steel or other protected metal but in preferred embodiments the platforms are constructed of polypropylene directly supported on the slide rails or with the interposition of anti-friction bearing material if required.

An embodiment of the invention is illustrated by way of example in the accompanying drawings in which.

Figure 1:
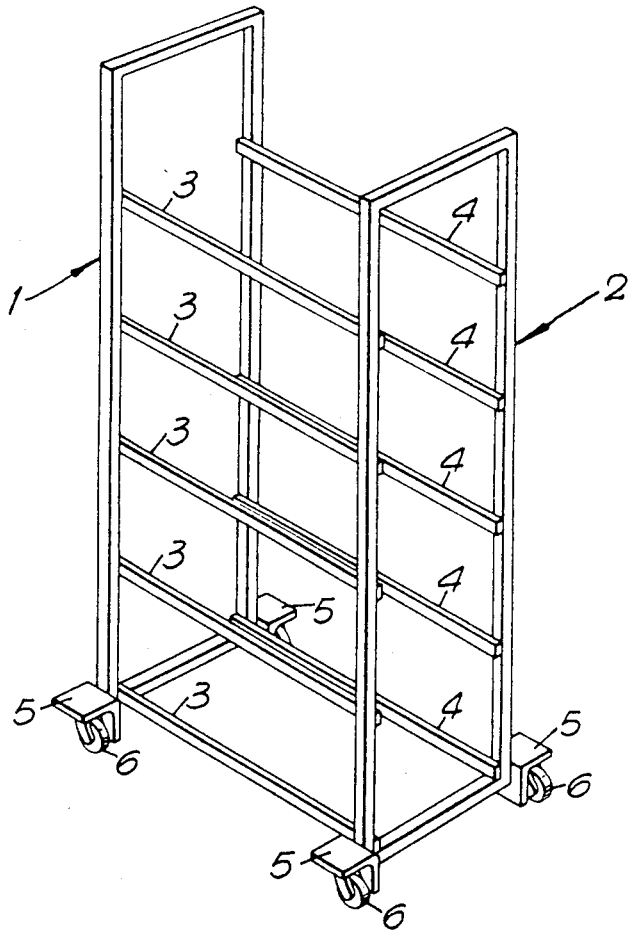
FIG. 1 is a schematic perspective view of a supporting structure in accordance with the invention.

The supporting structure shown in FIG. 1 of the drawings comprises a pair of portal end frames 1, 2 each comprising a pair of uprights linked at their upper and lower ends by cross members suitably secured thereto, as by welding. In the illustrated embodiment the uprights have a height of the order of 2 m and are spaced apart by about 680 mm, the uprights and the cross members being formed, for instance, of 40 mm square section stainless steel tubing.

Figure 4:
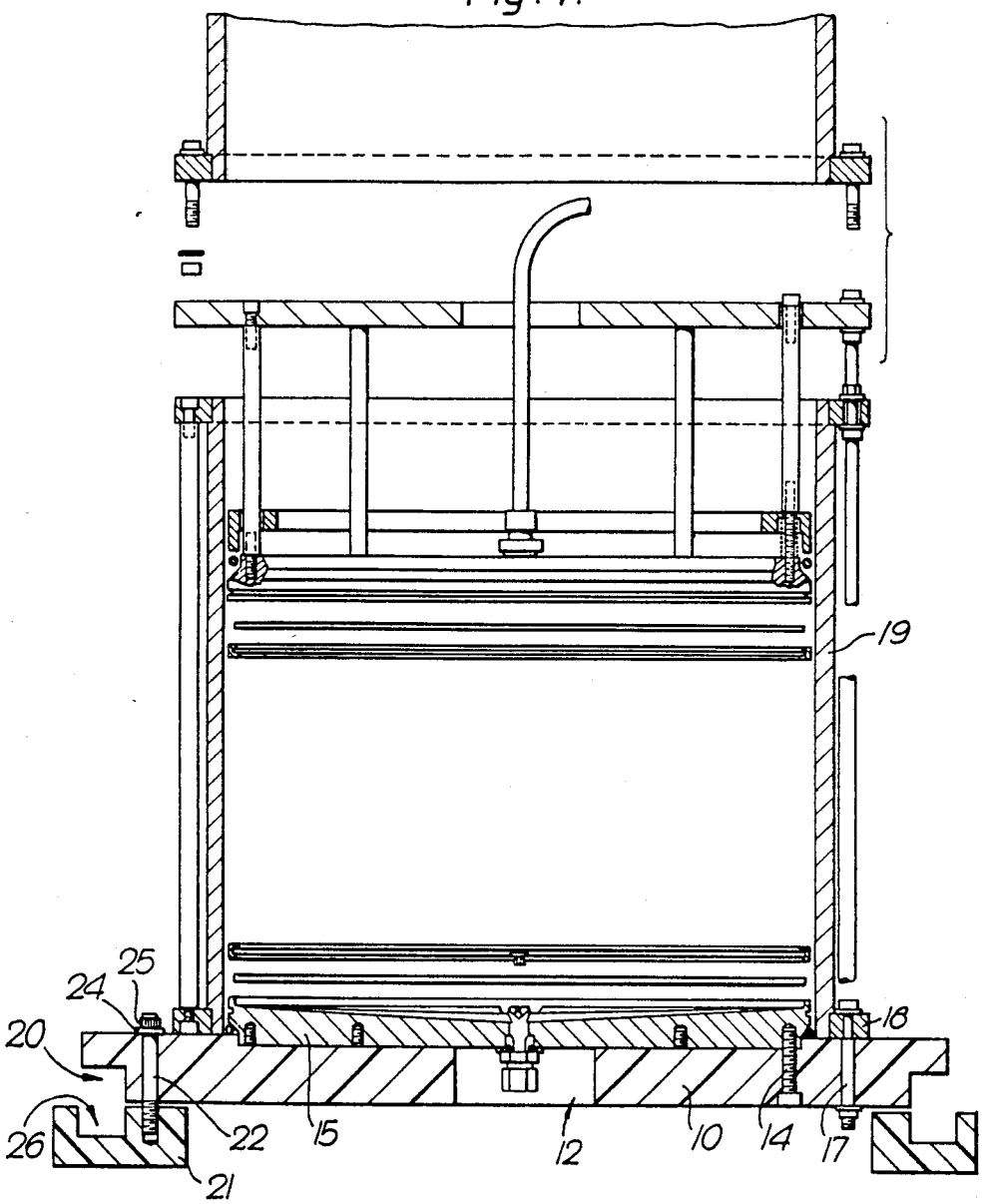
FIG. 4 is a part-sectional illustration of a typical column unit utilising the platform of FIGS. 2 and 3 as a bottom end plate and showing the clamping/stop means.

The end frames 1, 2 are joined by pairs of parallel, horizontal slide rails 3, 4 at five levels in the illustrated embodiment in order to support five platforms and associated column units of the construction illustrated in FIG. 4.

The slide rails 3, 4 are formed of rectangular section 20×40 mm stainless steel tubing welded to the inboard faces of the uprights of the end frames 1, 2 and so as to be accurately parallel with one another and level at the same height on each side, so that when the end frames are truly vertical the slide rail pairs 3, 4 will be parallel and truly horizontal.

In the embodiment illustrated, the slide rails 3, 4 have a length of about 1150 mm.

In this embodiment the lower ends of the uprights of the end frames 1, 2 have outriggers 5 fitted with wheels 6, the wheels carried by one end frame being fixed in direction parallel with the slide rails and the other pair of wheels being castor mounted. The outriggers 5 are attached to their respective uprights of the end frames 1, 2 in a manner providing for levelling adjustment of the end frames by rotation of height-adjusting bolts (not shown) extending upwardly into bushes in the lower ends of each of the end frame uprights.

Figure 2:
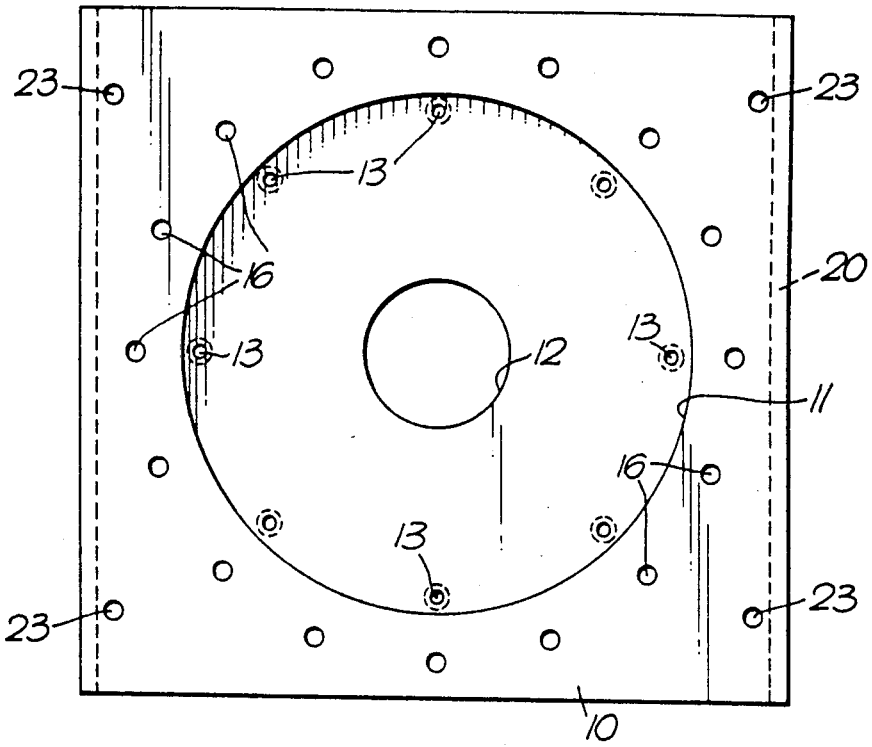
FIG. 2 is a plan view of a platform for use with the supporting structure of FIG. 1.
Figure 3:
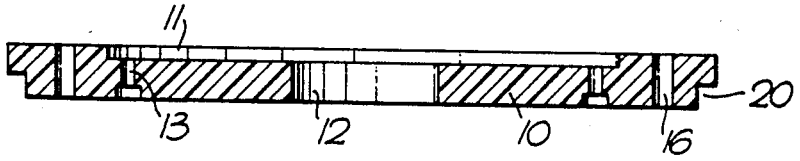
FIG. 3 is a vertical section of the platform shown in FIG. 2.

FIGS. 2 and 3 illustrate a combined platform and bottom end plate for a column unit to be carried by the supporting structure of FIG. 1. As illustrated in these Figures the platform 10 is a nominally rectangular plate, of 40 mm thick polypropylene, having a width of about 670 mm and a length of about 550 mm. The upper face of the platform 10 is formed with a circular central recess 11 having a diameter of about 425 mm and concentric with a central hole 12 having a diameter of about 120 mm. A ring of fixing holes 13, counterbored on the underside of the platform, are formed concentrically within the recess 11 to receive fixing bolts 14 for the lower end cell 15 of a column unit of the construction illustrated in FIG. 4, a further ring of fixing holes 16 being formed in the platform 10 outboard of the recess 11 to receive clamp bolts 17 that pass through a lower fixing flange 18 of a column tube 19.

Along its shorter edges, the underside of the platform 10 is formed with rebates 20 to engage over the slide rails 3, 4 of the supporting structure of FIG. 1 and to provide lateral location of the platform with respect to the slide rails that support it.

Figure 5:
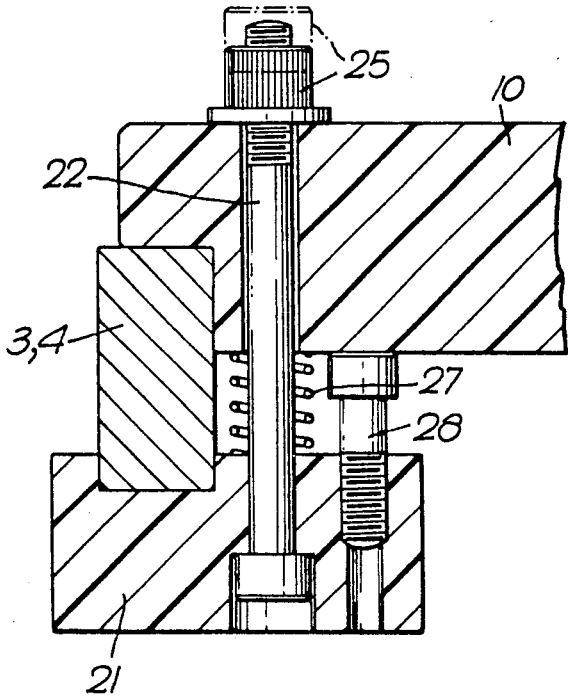
FIG. 5 is a sectional illustration of further details of the combined clamping/stop means.

Near each of its four corners the platform 10 is provided with integrated clamping and stop means the detailed construction of which is shown in FIG. 5 and that is illustrated schematically in FIG. 4. Each such means comprises a clamp jaw 21 formed from a disc of polypropylene secured to a pivot bolt 22 that extends through an eccentric bore in the jaw 21 and a corresponding bore 23 in the platform. The pivot bolt 22 is fitted with a washer 24 and a knurled or ribbed thumb nut 25 by tightening which the clamp jaw 21 may be drawn up towards the underside of the platform 10.

The jaw 21 has a groove 26 so dimensioned and positioned with respect to the pivot bolt 22 that in the position of the jaw illustrated in FIGS. 4 and 5 the groove 26 can engage and embrace the lower region of a slide rail 3 or 4 on which the platform 10 rests, as best shown in FIG. 5.

Thus with the jaw 21 positioned as shown in FIG. 5, tightening of the thumb nut 25 serves to clamp the platform 10 in position on the slide rail 3 or 4 engaged by the clamp jaw 21.

A coiled spring 27 encircles the pivot bolt 22 between the clamp jaw 21 and the underside of the platform 10 and serves to assist release of the clamping effort when the thumb nut 25 is released.

The clamp jaw 21 carries a headed screw 28 that as shown in FIG. 5 engages the underside of the platform 10 when the jaw 21 is in position embracing the lower part of a slide rail 3 or 4 and provides a fulcrum against which the clamping force, exerted by tightening of the nut 25 on the pivot bolt 22, can react.

The screw 28 also serves to limit rotation of the clamping jaw 21, with the pivot bolt 22, when the jaw is disengaged from a slide rail 3 or 4 as a result of slackening of the thumb nut 25.

Thus it should be understood that moderate slackening of the thumb nuts 25 of the four clamps will release the clamping effort upon the slide rails 3, 4 on which a platform 10 rests and thus permit the latter to be slidden along the slide rails. However with the grooves 26 of the clamp jaws 21 still loosely engaging the undersides of the slide rails, parts of the jaws 21 project outboard of the slide rails and thus into the path of the uprights of the end frame members that are, as described, secured to the outer faces of the slide rails. Accordingly with the clamps released enough to permit the platform 10 to slide on the slide rails, the permitted movement of the platform is between end positions determined by fouling of the clamp jaws 21 with the respective end frames 1 and 2.

However the arrangement is such that by further slackening of the thumb nuts 25 so as to enable the springs 27 to bring the upper faces of the clamp jaws 21 below the levels of the undersides of the slide rails 3, 4, the jaws 21 may rotate about the pivot bolts 22 to positions in which they no longer project outboard of the slide rails and prevent withdrawal of the platform through one or other of the two end frames.

To facilitate this rotation of the clamp jaws 21, they are rotationally fixed to their respective pivot bolts 22 and the threads of the latter engaged by the thumb nuts 25 are bruised so that sufficient torque is transmitted to the pivot bolts when the thumb nuts 25 are slackened to cause rotation of these, and the clamp jaws carried thereby, as soon as the grooves 26 are clear of the slide rails. However the rotation is limited by the screws 28 engaging the inner side faces of the slide rails when the jaws 21 have rotated to an appropriate extent to clear the paths of the adjacent end frame uprights when the platform is moved along the slide rails.

As has been described, each platform 10 also forms the bottom end plate of a column unit. The detailed construction of the column unit may be as required for any particular separation procedure and FIG. 4 serves merely to illustrate the construction of a form of column unit manufactured by the Applicant and well known to those involved in this art. The construction of this particular column unit will therefore not be further described.

In a column system including a supporting structure in accordance with the present invention, as many as five column units, each supported by its individual platform 10, may be disposed on the respective sets of slide rails 3, 4 of the supporting structure so as to be superposed one above the other. The adjacent end cells of the respective column units are interconnected by suitable flexible piping and desirably each column unit is associated with a by-pass valve so that communication may be established directly between the lower end cell of the next higher unit and the upper end cell of the next lower unit, thereby to enable, as is sometimes required, a particular column unit to be cut out of the fluid flow sequence during the course of the procedure.

In addition to the inter-unit connections, appropriate fluid flow connections are established with the upper end cell of the uppermost unit and the lower end cell of the lowermost unit.

In operation of such a system with the various interconnections established, the platforms 10 carrying the individual column units may be positioned as convenient on their respective slide rail pairs. Various configurations are possible, as will be apparent. However a typical configuration would be with all the platforms correspondingly disposed on their respective slide rail pairs so that the column units were more or less vertically aligned. Although such vertical alignment might be effected with the platforms symmetrically disposed between the ends of their associated slide rail pairs, a more convenient arrangement is for all the platforms to be disposed at the corresponding ends of their respective travel on the slide rails—that is to say with all the platforms adjacent to one of the end frames 1, 2—because by virtue of this arrangement access to any one of the column units may be obtained merely by sliding the platform of that unit along its slide rails towards the other end frame.

Another possible configuration is with alternate platforms arranged adjacent to the respective end frames 1 and 2, thereby to provide limited access to all of the column units.

With its thumb nuts 25 released and the clamp 21 jaws suitably swung aside, any individual platform and its column unit may be slidden out of the supporting structure—for instance on to a pallet-like temporary support comprising a pair of slide rails that may be brought into alignment, by suitable lifting gear, with the slide rails 3, 4 on which the platform in question is supported. This facility of completely withdrawing a platform and column unit, without disturbing any other platform carried by the supporting structure, both enables a selected column unit to be exchanged for another, if need be, in the course of a separation procedure, and it also enables the supporting structure to support a pair of platforms and associated column units on each pair of slide rails—that is to say a total of ten platforms and column units in the case of the supporting structure of FIG. 1—with access to any individual column unit, without disturbance of the others, being obtainable by removal thereof through the adjacent end frame.

I claim:

1. A column system comprising:

a supporting structure for column units comprising a pair of upright end frames interconnected by pairs of horizontal slide rails at different levels, each pair of slide rails at an individual level being adapted slidably to carry a platform movable along said slide rails, said slide being disposed inboard of the uprights of the end frames so that a platform may be slid into and out of engagement with the slide rails by passing through at least one of the end frames, and stop means for preventing unintentional movement of a platform off its associated slide rails; and a plurality of platforms each carrying an individual column unit, wherein each platform includes clamping means for securing the platform in a desired position along the slide rail on which it rests, said clamping means being integrated with said stop means.

2. The column system of claim 1 wherein said integrated clamping and stop means comprises a clamp jaw movable relatively to the platform so as to grip an associated slide rail, the jaw being pivoted to the platform so as to be capable of being swung from a position in which it engages a slide rail and also projects into the path of an end frame member so as to obstruct movement of the platform out through such end frame, to another position in which the jaw clears the path of the end frame member in question to permit removal of the platform through the end frame.

3. The column system of claim 2 wherein the clamp jaw is grooved to engage the slide rail when the clamp jaw is in the position in which it projects into the path of the end frame member, so as to be prevented from being swung out of that position inadvertently and when not deliberately released from engagement with the slide rail.

4. The column system of claim 2 wherein the pivot for the clamp jaw by means of which the jaw is moved towards the platform to accomplish clamping of the platform to the side rail comprises a bolt.

5. The column system of claim 3 wherein the pivot for the clamp jaw by means of which the jaw is moved towards the platform to accomplish clamping of the platform to the side rail comprises a bolt.

6. The column system of claim 1 wherein the supporting structure has its end frames spaced apart by at least twice the length of a platform; and each platform is of norminally rectangular configuration.

7. A column system comprising:

a supporting structure for column units comprising:

a pair of upright end frames interconnected by pairs of horizontal slide rails at different levels, each pair of slide rails at an individual level being adapted slidably to carry a platform movable along such slide rails, said slide rails being disposed inboard of the uprights of the end frames so that a platform may be slid into and out of engagement with the slide rails by passing through at least one of the end frames and said end frames being spaced apart by at least twice the length of a platform; and integrated clamping means and stop means for securing a platform in a desired position along the slide rail pair on which it rests and for preventing unintentional movement of a platform off its associated slide rails comprising a clamp jaw movable relatively to the platform so as to grip an associated slide rail, the jaw being pivoted to the platform so as to be capable of being swung from a position in which it engages a slide rail and also projects into the path of an end frame member so as to obstruct movement of the platform out through such end frame, to another position in which the jaw clears the path of the end frame member in question to permit removal of the platform through the end frame, said clamp jaw being grooved to engage the slide rail when the clamp jaw is in the position in which it projects into the path of the end frame member, so that the clamp jaw is prevented from being swung out of that position inadvertently; and a plurality of platforms each carrying an individual column unit wherein each said platform is of nominally rectangular configuration and has a suitably configured bottom end plate for an associated column unit so that the column unit is thereby fixed in positive relative to the platform to prevent unwanted relative displacement of the column unit thereon.

* * * * *

UNITED STATES PATENT AND TRADEMARK OFFICE

CERTIFICATE OF CORRECTION

PATENT NO. : 4,582,204

DATED : April 15, 1986

INVENTOR(S) : A. G. Wright

It is certified that error appears in the above-identified patent and that said Letters Patent are hereby corrected as shown below:

Column 6, line 44, after the second "slide", insert --rails--.

Column 8, line 28, change "positive", to --position--.

Column 1, line 32, after "required", insert --large--.

Signed and Sealed this

*Second* Day of *September 1986*

[SEAL]

*Attest:*

DONALD J. QUIGG

*Attesting Officer*

*Commissioner of Patents and Trademarks*